US006647218B2

(12) United States Patent
Takayama

(10) Patent No.: US 6,647,218 B2
(45) Date of Patent: Nov. 11, 2003

(54) IMAGE FORMING APPARATUS THAT DISCRIMINATES AN ABNORMALITY IN A FIXING UNIT

(75) Inventor: Hirofumi Takayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/246,459

(22) Filed: Sep. 19, 2002

(65) Prior Publication Data

US 2003/0053811 A1 Mar. 20, 2003

(30) Foreign Application Priority Data

Sep. 20, 2001 (JP) ..... 2001/287556

(51) Int. Cl.[7] ..... G03G 15/20
(52) U.S. Cl. ..... 399/33; 399/33; 399/69
(58) Field of Search ..... 399/33, 67, 69, 399/70; 219/216, 471, 481, 494, 510; 361/103, 106

(56) References Cited

U.S. PATENT DOCUMENTS 4,001,545 A * 1/1977 Wada et al. ..... 219/216
4,663,941 A * 5/1987 Janke ..... 62/156
5,633,704 A * 5/1997 Suzuki et al. ..... 399/33
5,896,472 A 4/1999 Takayama ..... 382/287
6,498,906 B2 * 12/2002 Kimoto et al. ..... 399/33

FOREIGN PATENT DOCUMENTS

JP 09329998 A * 12/1997 ..... G03G/21/00
JP 10198232 A * 7/1998 ..... G03G/21/00
JP 2000347532 A * 12/2000 ..... G03G/15/20
JP 2001125427 A * 5/2001 ..... G03G/15/20

* cited by examiner

*Primary Examiner*—Robert Beatty
*Assistant Examiner*—Ryan Gleitz
(74) *Attorney, Agent, or Firm*—Fitzpatrick, Cella, Harper & Scinto

(57) ABSTRACT

An image forming apparatus includes image forming unit for forming an image on a recording material; a fixing unit for heating and fixing the image on the recording material, said fixing unit having a heater for generating heat upon electric energy supply thereto and a temperature detecting element for detecting a temperature; an abnormality detecting unit for discriminating an abnormality of said fixing unit on the basis of an output of said temperature detecting unit; a shutting unit for shutting electric energy supply to said heater; a storing unit for storing an event of discrimination of the abnormality; and an erasing unit for erasing abnormality data stored in said storing unit, when said fixing unit starts up normally upon electric power supply to said apparatus.

5 Claims, 4 Drawing Sheets

IMAGE FORMING APPARATUS THAT DISCRIMINATES AN ABNORMALITY IN A FIXING UNIT

FIELD OF THE INVENTION AND RELATED ART

The present invention relates to an image forming apparatus such as an electrophotographic apparatus, an electrostatic recording apparatus, and the like, in particular, an image forming apparatus comprising a fixing device for fixing developer such as toner to recording paper.

In the field of an image forming apparatus, such as a copying apparatus, a printer, or the like, employing an electrophotographic or electrostatic recording method, it is common practice to thermally fix an unfixed image formed on a recording medium, for example, paper, to the recording medium with the use of a fixing device.

A fixing device used for the above described purpose usually comprises a heat roller as a thermal fixing member, and a pressure roller. The heat roller internally holds a heater. The pressure roller rotates while being kept in contact with the heat roller with a predetermined amount of pressure. In order for an image forming apparatus to be superior in terms of fixing performance, the temperature of the fixing roller must be kept at a proper level.

Thus, in order to prevent the fixing device from abnormally heating, the control section monitors the temperature of the fixing roller with the use of a temperature sensor such as a thermistor. Even when a fixing device anomaly, for example, overheating, is detected, the anomaly, or the abnormal temperature of the fixing roller, sometimes continues because a user turns off, and then, turns on, the power source to the image forming apparatus, in an attempt to restart the apparatus in order to restore the fixing device. In the past, in order to prevent the above described phenomenon, the data regarding the fixing device anomaly were written in a nonvolatile memory (EEPROM), or the like, and as the apparatus is restarted, the contents of this nonvolatile memory were checked. If the presence of the fixing device anomaly data was detected in the nonvolatile memory, control was executed so that electrical power was not supplied to the fixing heater.

In the case of an image forming apparatus such as the one described above, once fixing device anomaly data were written into the nonvolatile memory, the apparatus could not be normally started up, unless the fixing device anomaly data were eliminated. In order to eliminate the anomaly data, it was necessary to bring in a service person, or carry out a specific anomaly data elimination operation.

There are various fixing device anomalies, although their occurrences are quite rare. For example, there is the startup error which occurs when voltage remains abnormally low for an extended period of time. There is the heater "runaway" or excessive temperature increase, resulting from the malfunction of the control section caused by excessive noise or the like. Further, sometimes, the control section detects an abnormally high temperature due to the timing with which the power source to the apparatus is turned off, and then, turned on, after the detection of the truly abnormally high temperature, and therefore, falsely determines that the fixing device is in the abnormal state. As a fixing device anomaly such as those described above occurs, a service person or the like will be requested even if nothing is wrong with the apparatus itself.

SUMMARY OF THE INVENTION

The primary object of the present invention is to provide an image forming apparatus which is a highly reliable image forming apparatus.

Another object of the present invention is to provide an image forming apparatus, the operation of which is not suspended due to erratic anomaly detection.

Another object of the present invention is to provide an image forming apparatus, the operation of which can be reliably recovered by the turning off and on of the power source switch, even when there are fixing device anomaly data in the memory.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described with reference to the appended drawings.

Figure 1:
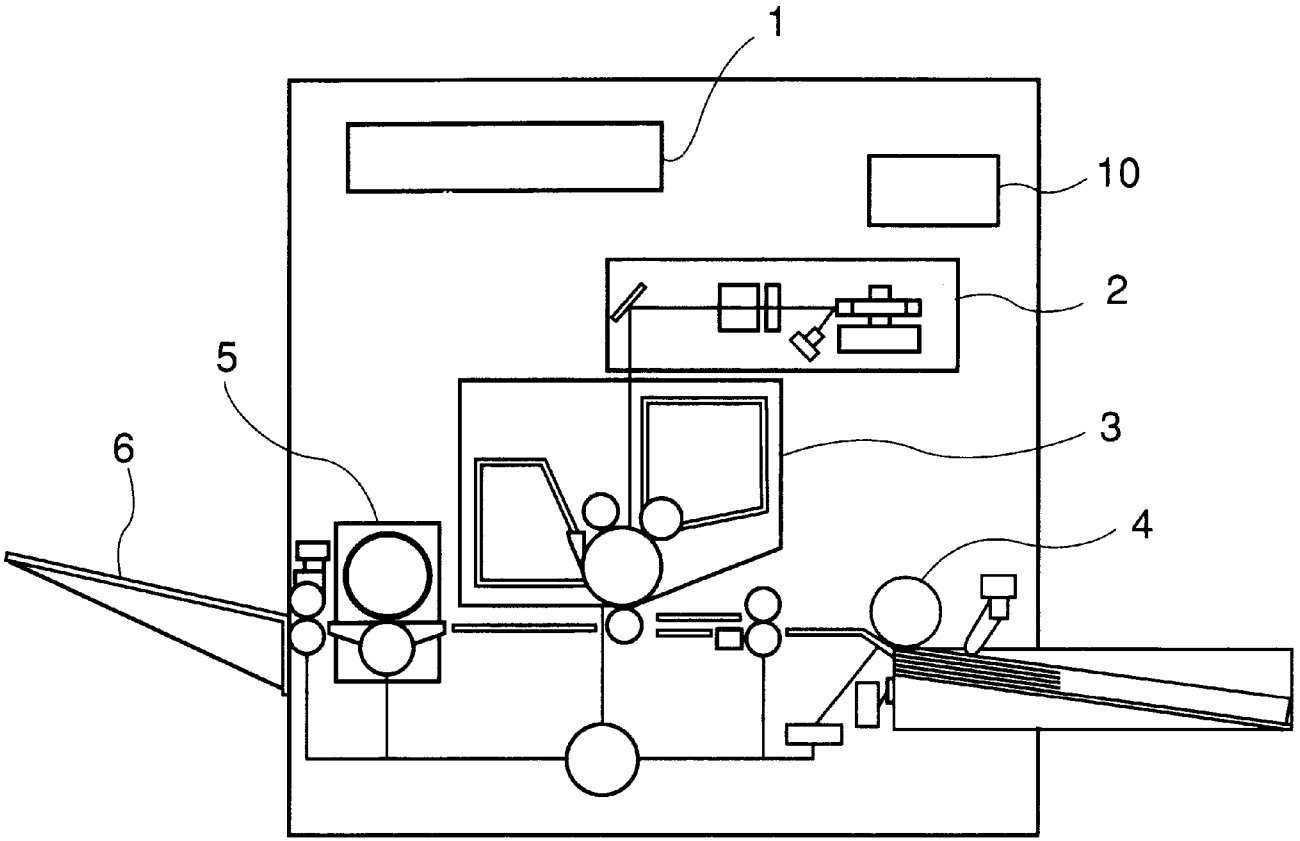
FIG. 1 is a schematic sectional view of a printer, as an example of an image forming apparatus compatible with the present invention, for showing the general structure thereof.

First, referring to FIG. 1, the structure of an electrophotographic laser beam printer, as an example of an image forming apparatus compatible with the present invention, will be described. This printer primarily comprises a control panel section 1, a scanner section 2, an image forming section 3, a paper feeding section 4, a fixing device 5, a paper discharging section 6 (delivery tray), and a control section 10. The laser beam projected from the semiconductor laser, as a light source, in the scanner section 2 is deflected by a rotational polygonal mirror. Being deflected, the laser beam is projected onto the peripheral surface of a photoconductive drum, that is, an electrostatic latent image bearing member, in the image forming section 3, in a manner to scan the peripheral surface. As a result, an electrostatic latent image is formed on the peripheral surface of the photoconductive drum. Prior to this formation of an electrostatic latent image, the photoconductive drum is uniformly charged by a charge roller. The electrostatic latent image formed through the exposure of the peripheral surface of the photoconductive drum by the laser beam is developed into a toner image by the developing device which employs toner. This toner image is transferred onto a piece of recording paper conveyed to the image forming section 3, with a predetermined timing, after being fed into the image forming apparatus main assembly from the paper feeding section 4. Then, the toner image on the recording paper is welded (fixed) to the recording paper. Finally, the recording paper is discharged into the delivery tray 6. As is evident from the above description, the image forming apparatus in this embodiment is the same in basic structure and operation as a known conventional image forming apparatus in accordance with the prior art.

Next, a method for controlling the fixing device 5, which is the primary aspect of the present invention, will be described in detail.

Figure 2:
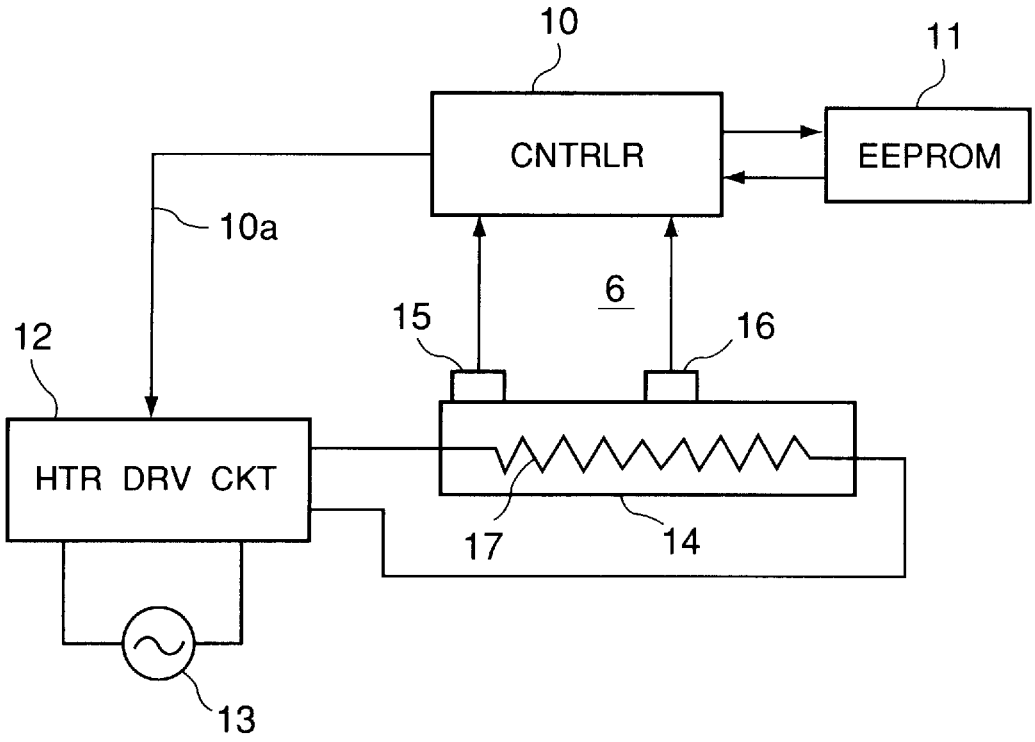
FIG. 2 is a block diagram showing the hardware structure of the control system of the fixing device of the printer.

FIG. 2 is a block diagram showing the hardware structure of the control system of the fixing device 5. The control section 10 controls the heater of the fixing device 5. An EEPROM 11 is a nonvolatile memory for storing anomaly data or the like. A heater drive circuit 12 is connected to an AC power source 13, and turns on a fixing heater 17 in the fixing roller 14, as a thermal fixing member, in response to the heater activation signal 10*a* sent from the control section 10. A main thermistor 16 is positioned close to the center portion of the fixing roller 14, and a sub-thermistor 15 is positioned close to one of the lengthwise ends of the fixing roller 14. Both thermistors function as temperature sensors. In order to keep the temperature of the fixing roller 14 at a predetermined image fixation level during an image forming process, the control section 10 constantly monitors the temperatures which the main and sub-thermistors detect, and controls the temperature of the fixing roller 14 by turning on or off the fixing heater 17 in response to the temperatures detected by the thermistors.

Figure 3:
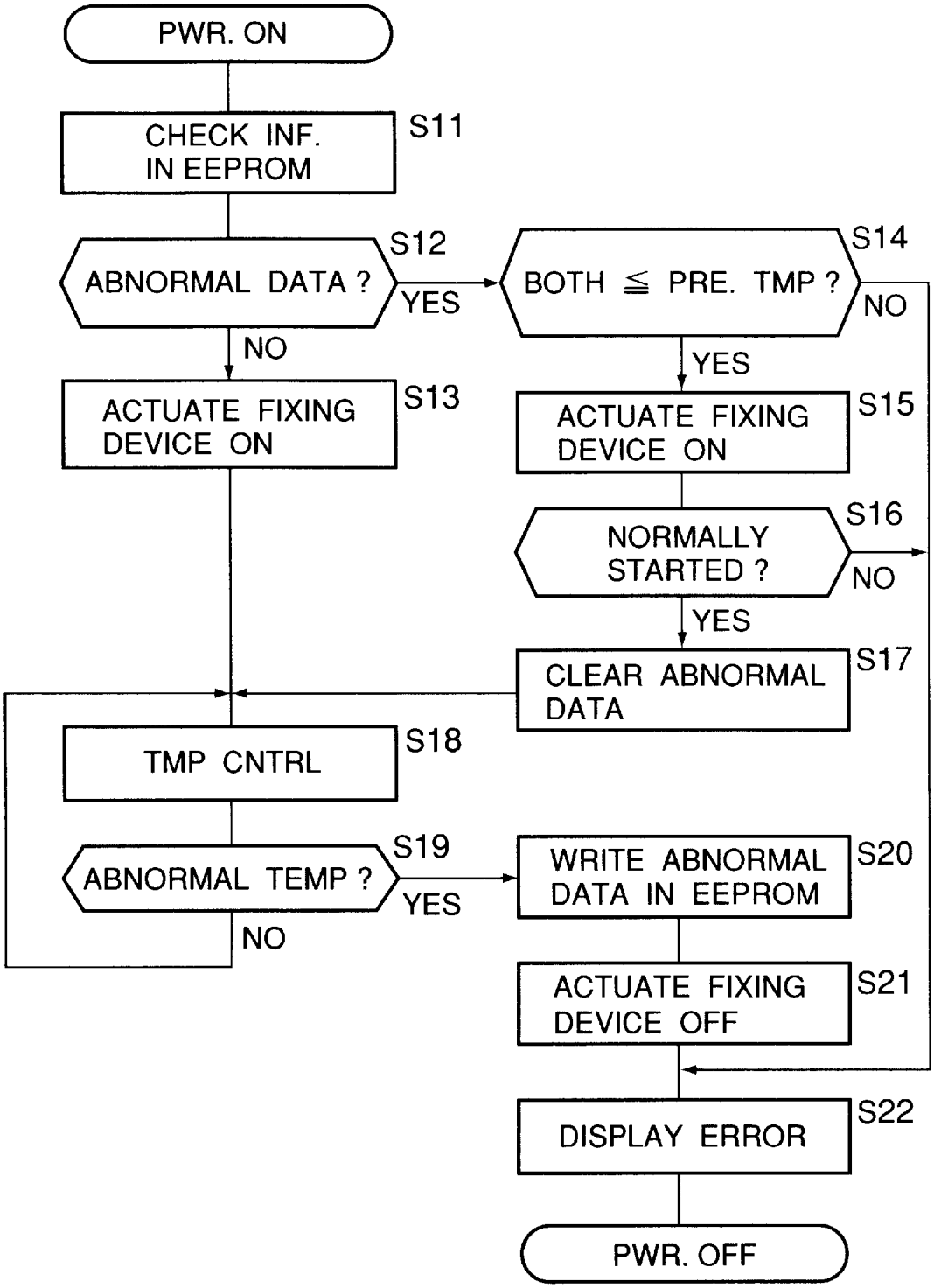
FIG. 3 is a flowchart showing the operational sequence of the control section of the fixing device in FIG. 2.

FIG. 3 is a flowchart showing the operational sequence carried out by the control section 10 in order to control the fixing device 5.

As the power source to the image forming apparatus is turned on by a user, the control section 10 determines whether or not the information regarding the fixing device anomaly are in the EEPROM 11 (S11). If there are no fixing device anomaly data in the EEPROM 11 (S12, No), it starts supplying the fixing device with power (S13), and carries out the normal fixing device temperature control operation (S18), while monitoring the fixing device (S18). If a fixing device anomaly is detected (S19, Yes), the control section 10 writes the data regarding the detected fixing device anomaly into the EEPROM 11 (S20), and stops (OFF) supplying the fixing device with power (S21). Also, it display an error message on the display panel portion of the control panel section 1 (S22). When a plurality of temperature sensors (main and sub-thermistors) are employed, whether or not a fixing device anomaly is present (S19) is determined based on the logical sum of the results obtained by the plurality of sensors; in other words, when it is determined that the temperature detected by one of the plurality of sensors is abnormal, it is determined that the temperature of the fixing device is abnormal.

If fixing device anomaly data are found in Step S12 (S12, Yes), the control section 10 confirms the temperatures detected by the main and sub-thermistors, and determines whether or not both temperatures are no higher than a predetermined level (S14). In other words, the decision is made based on the logical sum of the temperatures detected by both temperature sensors. When it is determined that both of the detected temperatures are no higher than the predetermined level, the control section 10 starts supplying the fixing device with power (S15). Next, it is determined whether or not the fixing device has normally started up (S16). If it is confirmed that the fixing device has normally started up (S16, Yes), the control section 10 clears the fixing device anomaly data in the EEPROM 11 (S17), and takes Step S18. If the temperatures detected by the thermistors are no less than the predetermined level (S14 No), or the fixing device has not normally started up (S16, No), the control section10 does not clear the EEPROM 11, does not supply the fixing device with power, and displays an error message on the display panel (S22). From this point on, unless the fixing device anomaly data within the EEPROM 11 are cleared, that is, unless a specific procedure is carried out by a service person or the like, the fixing device anomaly cannot be dissolved.

Figure 4:
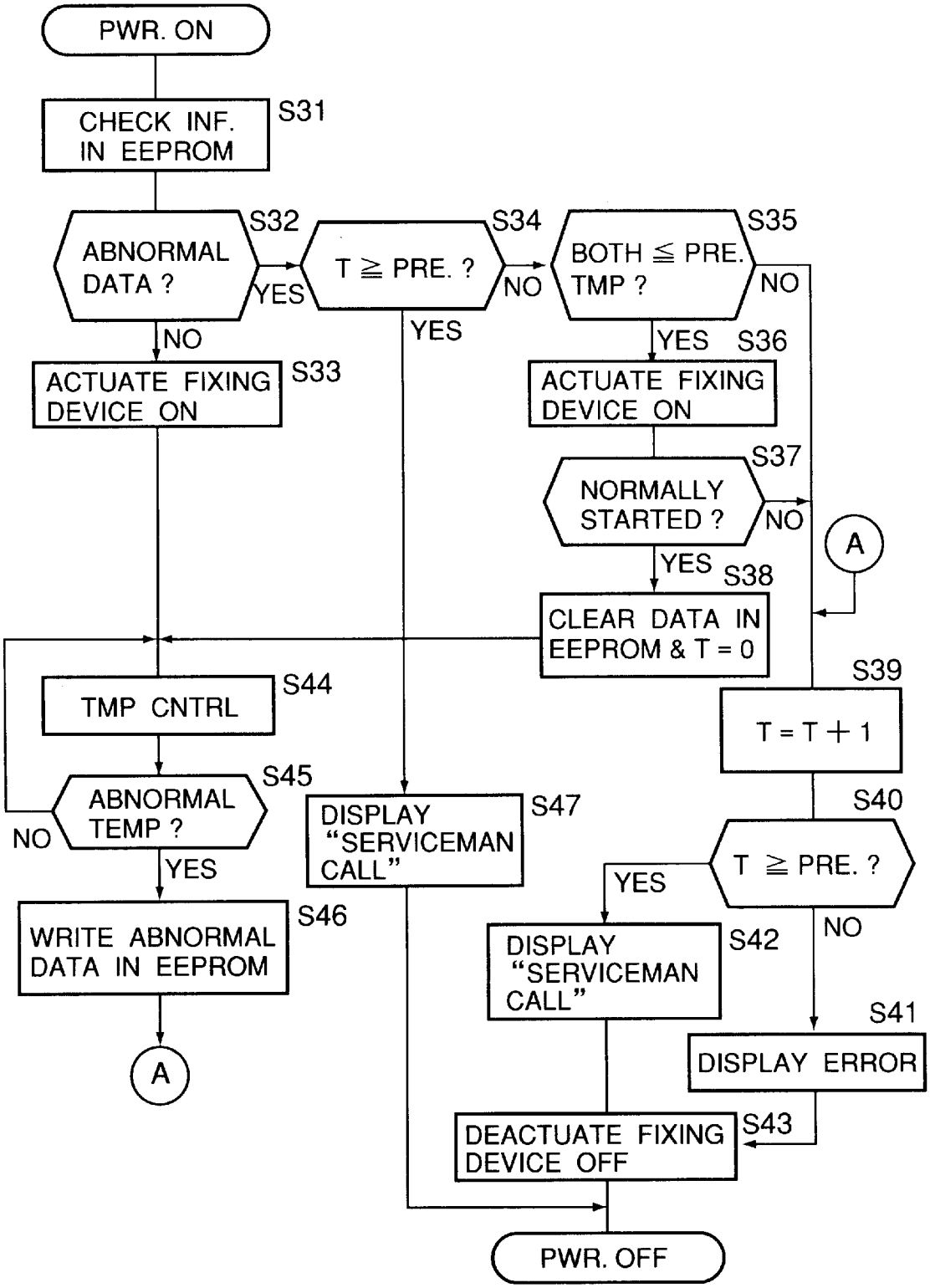
FIG. 4 is also a flowchart showing the operational sequence of the control section of the fixing device in FIG. 2.

FIG. 4 is a flowchart showing the operational sequence carried out by the control section 10 in order to control the fixing device 5 shown in FIG. 2. According to the sequence in FIG. 4, if the fixing device anomaly continuously occurs a predetermined number of times (for example, twice, three time, etc.), it is made impossible for the fixing device to be supplied with power during the attempts made thereafter in order to restart the apparatus to restore the fixing device. With the provision of this setup, once fixing device anomaly data are written into the nonvolatile memory, the attempt thereafter to restart the apparatus is permitted for only a predetermined number times; if the fixing device cannot be normally started up through the predetermined number of the attempts to restart the apparatus, it is determined that there is no hope for recovery, and even the simple starting of the apparatus is made impossible.

As the electrical power to the apparatus is turned on, the control section 10 determines whether or not fixing device anomaly data are in the EEPROM 11 (S31). If there are no fixing device anomaly data in the EEPROM 11 (S32, No), it starts supplying the fixing device with power (S33), and carries out the normal fixing device temperature control operation (S44). If a fixing device anomaly is detected (S45, Yes), the control section 10 writes the data regarding the detected fixing device anomaly into the EEPROM 11 (S46), and takes Step S39, which will be described later.

When fixing device anomaly data are found in EEPROM 11 in Step S32 (S32, Yes), it is determined whether or not anomaly detection count T has reached a predetermined value (S34). If it is determined that anomaly detection count T has reached the predetermined value, the control section 10 does not supply the fixing device with power, does not clear the EEPROM 11, and displays a message of "call service person" on the display panel (S47). If it is determined that anomaly detection count T has not reached the predetermined value, the control section 10 confirms the temperatures detected by the main and sub-thermistors, an determines whether or not both temperatures are no higher than a predetermined level (S35). If it is determined that both temperatures are no higher than the predetermined level, the power to the fixing device is started (S36). Then, it is determined whether or not the fixing device has normally started up (S37). If it is confirmed that the fixing device has normally started up (S37, Yes), the control section 10 clears the fixing device anomaly data in the EEPROM 11, clears anomaly detection count T to zero (S38), and takes Step S44, that is, the normal fixing device temperature control step.

If the temperatures detected by the thermistors are no less than the predetermined level (S35, No), or the fixing device has not normally started up (S37, No), the control section 10 does not clear the EEPROM 11, does not supply the fixing device with power, and adds one to the value of the anomaly detection count T in the EEPROM 11 (T=T+1) (S39). Then, the control section 10 determines whether or not the anomaly detection count T has reached the predetermined value (S40). If the anomaly detection count T has not reached the predetermined value, the control section 10 displays an error message on the display panel (S41), and stops the power to the fixing device (S43). If the anomaly detection count T has reached the predetermined value, the control section 10 display the message of "call service person" (S42), and stops the power to the fixing device (S43).

Also in this operational sequence, unless the fixing device anomaly data within the EEPROM 11 are cleared, that is, unless a specific procedure is carried out by a service person or the like, the fixing device anomaly cannot be dissolved.

Hereinbefore, the preferable embodiments of the present invention were described. However, the present invention can be embodies in various forms different from the above described ones, and also, the above described ones can be modified in various forms.

According to one of the characteristic aspect of the present invention, if fixing device anomaly data are found in a volatile memory, the outputs of a single or plurality of temperature sensors are compared with a predetermined temperature level for the fixing device in order to check the temperature of the fixing device. If the temperature of the fixing device is no higher than the predetermined level, power is supplied to the fixing device, and then, it is determined whether or not the fixing device normally functions. If it is determined that the fixing device functions normally, the fixing device anomaly data in the nonvolatile memory are erased, and the power supply to the fixing device is continued. With the provision of this arrangement, even if an anomaly occurs to a fixing device for some reason, it is unnecessary to ask for a service person, as long as the anomaly is temporary; the fixing device can be restored to its normal operation simply by restarting it.

Further, while fixing device anomaly data are in the nonvolatile memory, power is supplied to the fixing device only when it is confirmed that the temperatures detected by the temperature sensors are no higher than the predetermined level. Therefore, while the temperature of the fixing device remains higher than the predetermined level after the power supplied to the fixing device is stopped due to the abnormal temperature of the fixing device, the power supply to the fixing device is not started even if the power to the apparatus is turned off, and then, turned on in order to restart the apparatus to restore the fixing device.

Further, according to another characteristic aspect of the present invention, the number of times fixing device anomaly continuously occurs is counted, and if the fixing device anomaly count reaches a predetermined value, it is made impossible to restart the apparatus, preventing power from being wastefully supplied to the fixing device.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

image forming means for forming an image on a recording material;

fixing means for heating and fixing the image on the recording material, said fixing means having a heater for generating heat upon electric energy supply thereto and a temperature detecting element for detecting a temperature;

abnormality discriminating means for discriminating an abnormality of said fixing means on the basis of an output of said temperature detecting element after start of electric energy supply to said heater by actuation of a main switch of said apparatus;

storing means for storing an event of discrimination of the abnormality by said abnormality discriminating means, wherein when the main switch is actuated during a time period that said storing means stores the event of discrimination of the abnormality, the electric energy supply is carried out again, and then said abnormality discriminating means discriminates the abnormality;

a counter for counting a number of consecutive discriminations of an abnormality by said abnormality discriminating means; and prohibiting means for prohibiting the electric energy supply to said heater by the actuation of the main switch when a count of said counter reaches a predetermined number.

2. An apparatus according to claim 1, further comprising erasing means for erasing data of the abnormality stored in said storing means when said fixing means starts up in order before the count reaches the predetermined number.

3. An apparatus according to claim 1, wherein when the count reaches the predetermined number, a call serviceman instruction is produced.

4. An apparatus according to claim 1, wherein said fixing means has a fixing member which is contactable with the recording member and which is heated by the heater, wherein said temperature detecting means detects a temperature of said fixing member.

5. An apparatus according to claim 1, wherein said storing means has non-volatile memory.

* * * * *

UNITED STATES PATENT AND TRADEMARK OFFICE

CERTIFICATE OF CORRECTION

PATENT NO. : 6,647,218 B2
DATED : November 11, 2003
INVENTOR(S) : Hirofumi Takayama It is certified that error appears in the above-identified patent and that said Letters Patent is hereby corrected as shown below:

Title page,
Item [56], References Cited, FOREIGN PATENT DOCUMENTS,
"09329998" should read -- 09-329998 --;
"10198232" should read -- 10-198232 --;
"2000347532" should read -- 2000/347532 --; and
"2001125427" should read -- 2001/125427 --.

Column 3,
Line 61, "section10" should read -- section 10 --.

Column 4,
Line 11, "number" should read -- number of --.
Line 35, "an" should read -- and --.
Line 60, "display" should read -- displays --.

Column 5,
Line 3, "embodies" should read -- embodied --.
Line 6, "aspect" should read -- aspects --.

Signed and Sealed this

Fourth Day of May, 2004

JON W. DUDAS
*Acting Director of the United States Patent and Trademark Office*